United States Patent [19]

Braden

[11] Patent Number: 4,966,368

[45] Date of Patent: Oct. 30, 1990

[54] GEOMETRIC TENNIS LANES

[76] Inventor: Victor K. Braden, 22395 Via Alonra, Coto de Caza, Calif. 92679

[21] Appl. No.: 321,902

[22] Filed: Mar. 10, 1989

Related U.S. Application Data

[63] Continuation-in-part of Ser. No. 47,622, May 7, 1987, abandoned.

[51] Int. Cl.[5] ..... A63B 69/38

[52] U.S. Cl. ..... 273/29 A; 273/182 R

[58] Field of Search ..... 273/29 R, 29 A, 26 R, 273/26 A, 176 R, 176 A, 176 AB, 176 G, 181 R, 181 F, 182 R, 182 A; 272/2, 3

[56] References Cited

U.S. PATENT DOCUMENTS

| | | | |
|---|---|---|---|
| 2,823,034 | 2/1958 | Bingham, Jr. | 273/29 R |
| 3,858,880 | 1/1975 | Graves . | |
| 3,948,512 | 4/1976 | Worthington | 273/29 A |
| 3,980,304 | 9/1976 | O'Neill et al. | 273/26 A |
| 4,070,018 | 1/1978 | Hodges | 273/29 A |
| 4,088,317 | 5/1978 | Gierla . | |
| 4,204,679 | 5/1980 | Kreuzman | 273/29 A |
| 4,239,235 | 12/1980 | Torres | 273/395 |
| 4,436,304 | 3/1984 | Castleman et al. | 273/29 A |
| 4,703,931 | 11/1987 | Steen | 273/26 A |
| 4,781,385 | 11/1988 | Harley | 272/3 |

OTHER PUBLICATIONS

"Sex and Tennis", *Time Magazine,* Sep. 6, 1976, by Dr. Herbert Hendin.

*Primary Examiner*—Edward M. Coven
*Assistant Examiner*—William E. Stoll
*Attorney, Agent, or Firm*—Cleveland R. Williams

[57] ABSTRACT

Geometrical tennis lanes are disclosed which comprise a plurality of pie-shaped lanes forming a circle or a semi-circle or substantially circular configuration, the lanes are substantially triangular in shape. The tennis lanes particularly provide for upright-side targets that are strategically positioned so as to indicate if a hit tennis ball would be in or out of court on a full-sized tennis court. The lanes additionally provide a central target area simulating a standard net, top band of the net and area above the net. In addition, a tennis net is provided that is removably connected between two side wall support posts to simulate the area in a normal court for hitting volley shots. Each tennis lane is separated from other lanes by side walls, thus allowing a number of players to practice simultaneously. Additionally, each lane is equipped with tennis ball-throwing means and a simple means for automatically collecting tennis balls. A net or other suitable material is provided to cover the top of the tennis lanes herein. It is desirable to have a top net or other barrier to prevent tennis balls from traveling to other lanes during a practice session. However, the net or other barrier may be removed from the top of the tennis lanes, for example, when the tennis player is practicing volleys.

20 Claims, 3 Drawing Sheets

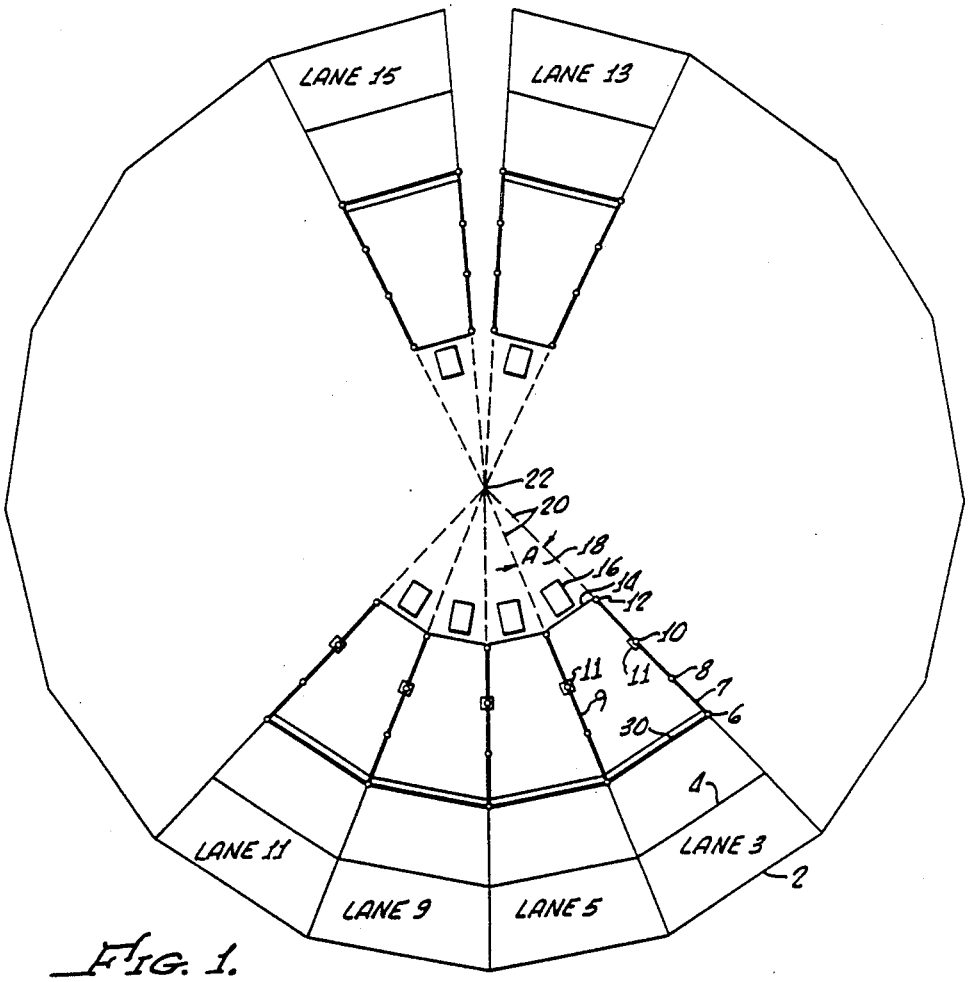
FIG. 1.
FIG. 2.
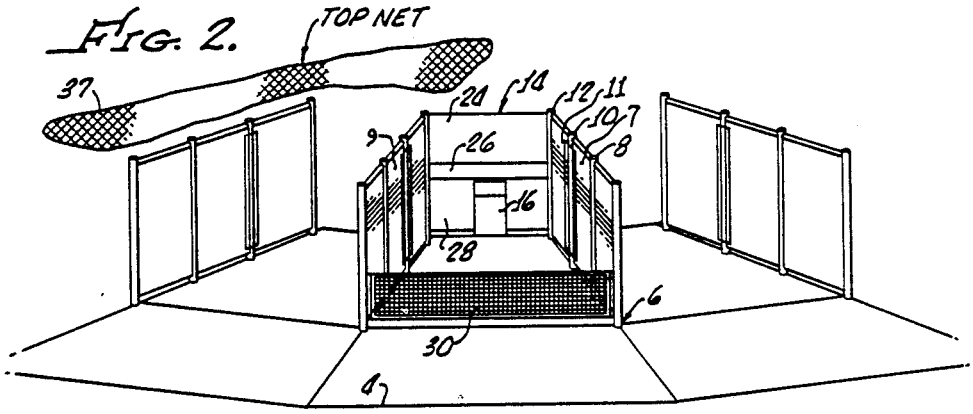

GEOMETRIC TENNIS LANES

This application is a Continuation-In-Part of application Ser. No. 047,622, filed May 7, 1987, now abandoned.

BACKGROUND OF THE INVENTION

1. Field Of The Invention:

This invention relates to geometrical tennis lanes which are particularly suited for creating a practice and learning environment for the novice as well as the seasoned tennis player. One novel feature of the invention resides in the geometric construction of the lanes which exactly duplicates the narrow, restricted target area range of a full size, conventional tennis court.

The improved tennis lanes provide a convenient and economical means for practicing basic tennis techniques, thus allowing the tennis player to focus attention on his body and racquet. In particular, the tennis lanes of the present invention provide the tennis player with a means to develop proper ground stroke technique, utilizing and understanding concepts of tennis ball spin, racquet acceleration, ball speed, body lift, shoulder rotation, tennis racquet follow-through and elevation or trajectory of the tennis ball traveling over the net.

2. Description Of The Prior Art

Presently, if a tennis player wishes to practice his tennis serve or other strokes, he has limited facilities available. Many tennis players practice with another player on a standard tennis court, but this has the disadvantage of using another player and a full-size court. A full-size court, however, does not allow the tennis player to maximize his time at practicing serves or strokes.

Efforts have been previously made to provide aids for tennis players. For example, U.S. Pat. No. 3,858,880 issued Jan. 7, 1975, relates to a plurality of rectangular-shaped courts, a central receiving court and a means for automatically collecting tennis balls.

U.S. Pat. No. 4,204,679 issued May 27, 1980, discloses a tennis practice service net which is described as useful in helping the tennis player improve his ability to stroke his serve consistently and with accuracy. This tennis practice service net is described as consisting essentially of a court net and an elongated rectangular practice service net overlying and co-planar with the court net, wherein said practice net inwardly of its ends and below its top being cut away defining an elongated rectangular opening over said court net.

U.S. Pat. No. 4,436,304 issued Mar. 13, 1984, relates to a tennis teaching aid for use on a tennis court. More particular, the patent describes a device suitable for use on a tennis court in combination with a standard net and net posts. The tennis teaching aid is described as a white target band simulating the top band of the standard net, but spaced above the top band of the standard net by a variable amount.

U.S. Pat. No. 4,088,317 issued May 9, 1978, discloses a portable tennis court which includes a net assembly consisting of two housings, wherein the net is contained on a reel assembly within one of the housings. The portable court is described as being readily assembled or disassembled into a tennis court.

U.S. Pat. No. 4,239,235 issued Dec. 16, 1980, relates to a training device for football, or other ball games. For tennis, the training device is described as advantageously replacing the traditional wall for training alone.

As can be readily determined from the above, there is an ongoing effort to provide teaching aids that will help the tennis player improve his tennis game.

Accordingly, it is an object of this invention to provide a plurality of geometrical tennis lanes forming a circle or a semi-circle to help the tennis player improve his ability to hit his serves with greater accuracy.

Another object of the invention is to provide a plurality of geometrical tennis lanes forming a circle or a semi-circle with strategically placed targets adjacent to each other and co-planar with the tennis lanes side borders, which targets exactly duplicate the precise angle that a tennis player must hit the ball within during a base-line to base-line shot. Hitting the ball within these targets serves to encourage the tennis player to hit the ball in a straight line. This is important because on a full-size court, whether the tennis player is hitting the ball down the line or cross-court, hitting the ball in a straight line is half the game.

Yet another object of the present invention is to provide geometrical tennis lanes containing a target area having three distinct target zones. These target zones duplicate the exact height of a standard tennis net, the top of the net and the area above the net.

It is yet another object of the present invention to provide geometrical tennis lanes having ball-throwing means and ball-collecting means.

Finally, it is still another object of this invention to provide a means for practicing volley shots.

These and other objects of the invention will be apparent to those skilled in the art from the following description in conjunction with the drawings.

SUMMARY OF THE INVENTION

The present invention relates to a plurality of geometrical tennis lanes forming a circle or a semi-circle and having pie-shaped configurations. The shape of the tennis lanes exactly duplicate the narrow, restricted target area range of a full-sized tennis court. The tennis lanes contain two distinct side targets, adjacent to each other and co-planar with the side borders of each lane. In addition, the tennis lanes contain a central target area which has three distinct target zones. A removable tennis net is provided that is separate from the central target area. The floor of the tennis lane comprises a downward slope which has three distinct downward slopes or inclines to facilitate collecting and retrieval of tennis balls. Finally, the tennis lanes contain ball-throwing means to facilitate and maximize the tennis player's practice time.

BRIEF DESCRIPTION OF THE DRAWINGS

The invention is further described by reference to the appended drawings taken in conjunction with the following description where:

FIG. 1 is an overall top drawing of the geometrical tennis lanes of the present invention showing major portions of the lanes.

FIG. 2 is a frontal perspective drawing of the geometrical tennis lanes which depicts the side barriers, side targets, central target area, removable tennis net and ball-throwing means of the present invention.

DETAILED DESCRIPTION OF THE INVENTION

Figure 3:
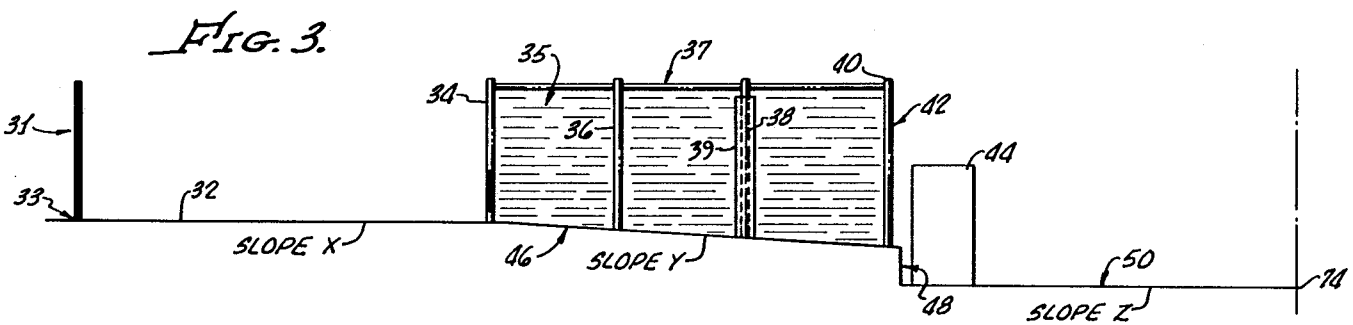
FIG. 3 is a longitudinal (vertical) cross-sectional view taken along the center line of a geometrical tennis lane showing the downward slope of the lane floor, said slope having three distinct slopes.

This invention resides in geometrical tennis lanes which are particularly suitable for providing the tennis player with a new and novel means for practicing basic tennis techniques.

The geometrical tennis lanes shown in FIG. 1. and FIG. 2. include illustrative examples of a plurality of tennis lanes 3, 5, 9, 11, 13, and 15 forming a circle or a semi-circle; each lane contains a boundary barrier 2 such as a fence, netting or canvas. In addition, each lane contains a base line 4, support posts 6, 8, 10, and 12, side targets 11, central target area 14 and pit area 22. The tennis lane borders or walls 7 and 9 are defined by angle (A) 18. Each lane 3, 5, 9, 11, 13, and 15 contain ball-throwing means, 16. Ball-throwing means 16 which are suitable for use herein are described in greater detail in co-pending U.S. patent application Ser. No. 47,617, filed on May 7, 1987, entitled "Ball Feeding And Throwing Apparatus" the disclosure of which is incorporated herein by reference in its entirety.

The overall length of the geometric tennis lanes generally is from about 63 feet to about 100 feet, especially from about 68 feet to about 91 feet, preferably from about 68 feet to about 75 feet. The border or side wall of each lane is defined by angle (A) 18 which is an angle of from about 19 degrees to about 30 degrees, preferably from about 22 degrees to about 28 degrees, most preferably from about 22 degrees to about 25 degrees as measured from the center of pit area 22. Pit area 22 is defined by a radius of from about 10 feet to about 40 feet, especially from about 20 feet to about 35 feet, preferably from about 25 feet to about 30 feet. Central target area 14 is positioned adjacent to the pit area 22 and to the front of ball-throwing means 16.

The baseline 4 and central target area 14 are separated from each other by a distance which duplicates the distance between the baseline and net on a standard size tennis court. Thus, baseline 4 and central target area 14 are separated by a distance of from about 34 feet to about 45 feet, especially from about 36 feet to about 43 feet, preferably from about 38 feet to about 40 feet. Ideally the baseline and central target area are separated by a distance of 39 feet because this is the true distance between the baseline and center net on a full size, regulation tennis court. Removable net 30 is removably attached to support post 6; support post 6 is representative of two supports mutually spaced apart and co-planar with geometric tennis lane borders 7 and 9, where said baseline and removable net 30 are separated by a distance of from about 8 feet to about 14 feet, preferably from about 9 feet to about 12 feet, most preferably from about 9 feet to about 10 feet. Removable net 30 is located at support 6 for the express purpose of allowing the tennis player to practice volley shots.

In FIG. 2, tennis lane borders 7 and 9 are composed of an opaque material, one suitable material is canvas. Another suitable material is chain link, such as the metallic chain link used in a chain link fence. Central target area 14, is additionally composed of an opaque material, one suitable opaque material is canvas, however, other materials may be used. Central target area 14, is composed of three distinct target areas, namely a bottom target zone 28 which represents a standard size tennis net, a middle target zone 26 which represents the top border of a standard size tennis net, and a top target zone 24, which represents the area above a standard size tennis net. An opening in central target 14 is provided so that ball-throwing means 16 may throw tennis balls to the tennis players. The opening in central target 14 is not germane to this invention, however, it should be large enough for a standard size tennis ball to pass through.

The three target zones of central target 14 preferably are colored with three different colors to allow the tennis player to readily identify each target zone while standing at base line 4.

The representation of FIG. 3. shows a floor area 33 having a downward slope, wherein said downward slope has three distinct slopes. The first slope (X) 32 has a downward incline of from about 1% to about 4%, especially from about 1% to about 3%, preferably from about 2% to about 3%. The second slop (Y) 46 has a downward incline of from about 2% to about 9%, especially from about 3% to about 8%, preferably from about 3% to about 7%. The third slope (Z) 50 has a downward incline of from about 1% to about 4%, preferably from about 1% to about 3%, most preferably from about 1% to about 2%.

Second slope 46 is elevated above and connectable attached to third slope 50 by wall 48. Wall 48 is generally defined by a distance of from about 1 foot to about 4 feet, preferably from about 2 feet to about 4 feet, most preferably from about 3 feet to about 4 feet. Third slope 50 extends outward to the center of pit area 74. Ball-throwing means 44 is anchored by suitable means to slope 50.

Tennis ball collecting means is effected by slope 33, which under the influence of gravity directs said balls to ball-throwing means 44.

In addition, central target area 42 has an opening at the bottom thereof to allow tennis balls access to ball-throwing means 44. Generally the opening at the bottom of central target area 42 is from about 3 inches to about 8 inches, preferably from about 3 inches to about 4 inches, said opening extending along the entire bottom length of central target 42.

The downward slope percentage is calculated according to the following formula: a decline or downward slope of $\frac{1}{8}$ inch per foot is equal to a 1% decline; a decline of $\frac{1}{4}$ inch per foot is equal to a 2% decline, while a decline of $\frac{3}{4}$ inch per foot is equal to a 6% decline.

The outer barrier 31 of the geometric tennis lanes may be a fence or other suitable material Side wall supports 34, 36, 38, and 40 are anchored to floor area 33 by suitable means and give support to side barrier 35 and central target 42. Side target 39 is removably attached to and superimposed on side wall support 38.

Removable top barrier 37 is supported by side supports 34, 36, 38, and 40. A net or other similar material is the desirable top barrier 37. It is preferred that the geometrical tennis lanes have a top barrier 37, however, said lanes can be utilized without said top barrier 37. Top barrier 37 aids in preventing tennis balls from being thrown or hit out of said lanes.

Figure 4:
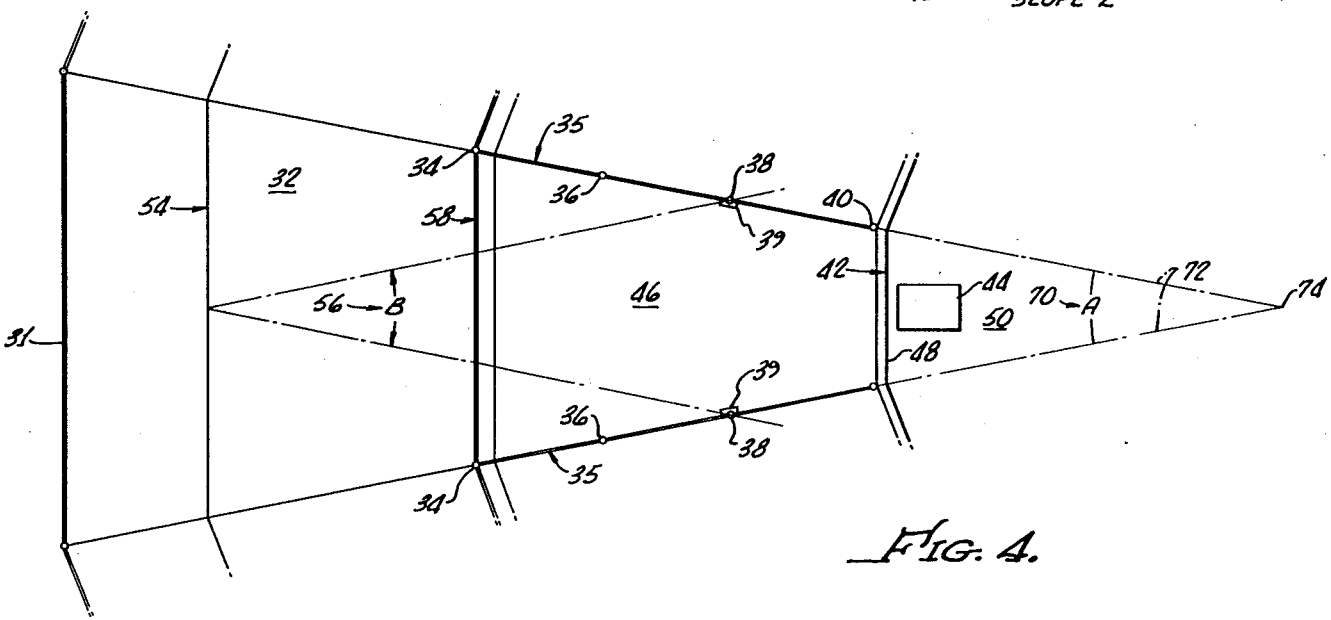
FIG. 4 is a top view of a geometrical tennis lane which depicts the angles involved in describing the lane walls or borders and the location of the side targets.

FIG. 4. is a top view of FIG. 3. and is representative of the angles utilized to define certain elements of the geometric tennis lanes herein. Outer barrier 31 and center pit area 74 depict the calculated length of said lanes as described in the description of FIG. 1. Center pit area 74 is the point of origin for angle (a) 70 which describes side borders 72 and 35 of each individual lane.

Side target 39 is an elongated rectangular structure in cross section which has a height of from about 4 feet to about 18 feet, preferably from about 14 feet to about 18 feet; a width of about 3 inches to about 6 inches, preferably from about 4 inches to about 6 inches; and a length of from about 3 inches to about 6 inches, preferably from about 4 inches to about 6 inches.

The position of side target 39 which is representative of two separate and mutually spaced apart side targets is described by angle (B) 56 as measured from the center of baseline 54 and intersecting with the tennis lane side border 35 at side target 39. The position of each side target 39 is defined by angle (B) of from about 17 degrees to about 25 degrees, preferably from about 19 degrees to about 23 degrees, most preferably from about 19 degrees to about 21 degrees as measured from the center of baseline 54 and intersecting with tennis lane side borders 35 at side target 38. Removable net 58 is connectably attached to side supports 38. Wall 48 is as described in the description of FIG. 3.

Figure 5:
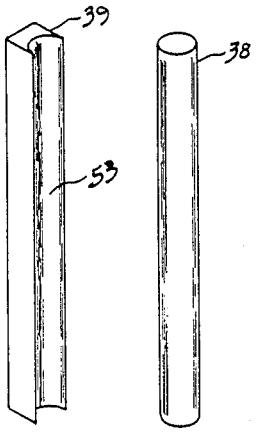
FIG. 5 is a perspective drawing which depicts a side target of the present invention.

FIG. 5 is a perspective view of side target 39 which has a concave cavity 53 extending the entire length of side target 39. Concave cavity 53 is designed to be superimposed on and removably attached to support 38. Side target 39 is anchored to support 38 by suitable means.

Figure 6:
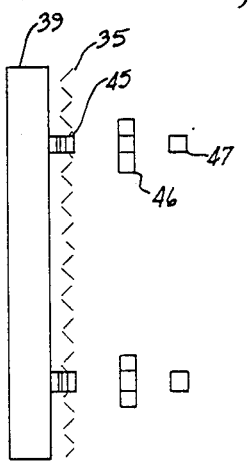
FIG. 6 is a side view of a side target which depicts an alternative embodiment of the present invention.

FIG. 6 is an alternative embodiment of the present invention. Particularly, FIG. 6 is a side view of side target 39 which contains a bolt 45, attachment plate 46 and nut 47 which connectably anchor side target 39 to side barrier 35.

Figure 7:
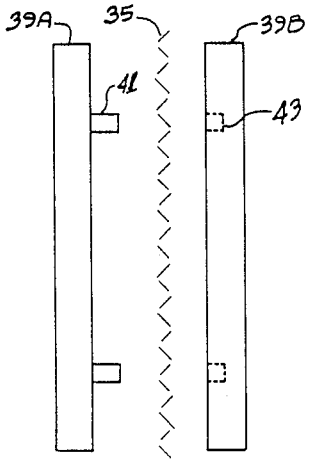
FIG. 7 is a side view of a side target which depicts yet another alternative embodiment of the present invention.

FIG. 7 is yet another alternative embodiment of the present invention. FIG. 7 is a side view of side target 39 depicting side targets 39A and 39B which connectably attach to each other and anchor to side barrier 35. Side target 39A contains male connecting unit 41 which connectably attaches to female connecting unit 43 utilizing suitable means.

Figure 8:
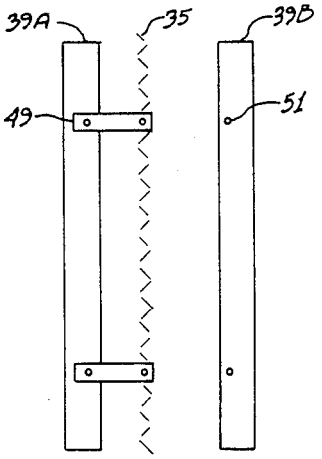
FIG. 8 is a side view of a side target which depicts still another alternative embodiment of the present invention.

FIG. 8 is still another alternative embodiment of the present invention. In particular, FIG. 8 is side view of side target 39 which is similar to the view in FIG. 7, except that connecting plate 49 connectably anchors side target 39A and 39B to side barrier 35 at position 51.

Figure 9:
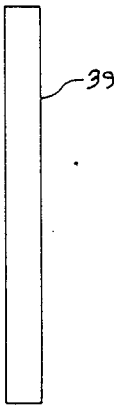
FIG. 9 is a side view of a free standing side target of the present invention.

FIG. 9 is a side view of a free standing side target 39 which is anchored to the tennis lane floor 46 (FIG. 3) at position 52, utilizing suitable means.

Obviously, many modifications and variations of the invention, as hereinbefore set forth, may be made without departing from the spirit and scope thereof, and therefore only such limitations should be imposed as are indicated in the appended claims.

I claim:

1. A plurality of geometrical tennis lanes forming a circle or a semi-circle and having generally triangular configurations, each of which comprises:

(a) a base line;

(b) a central target area;

(c) two separate elongated rectangular side targets, mutually spaced apart from each other, said side targets being co-planar with the side borders of each tennis lane wherein the location of the two separate side targets of each tennis lane is defined by an angle of from about 17 degrees to about 25 degrees as measured from the center of the base line and interconnecting with the border of each tennis lane;

(d) a pit area; and (e) a floor area having a downward slope.

2. The plurality of geometrical tennis lanes as claimed in claim 1 wherein the base line and central target area are separated by a distance of from about 34 feet to about 45 feet.

3. The plurality of geometrical tennis lanes as claimed in claim 1, wherein the two separate elongated rectangular side targets of each tennis lane are defined by a height of from about 4 feet to about 18 feet, a width of from about 3 inches to about 6 inches and a length of from about 3 inches to about 6 inches.

4. The plurality of geometrical tennis lanes as claimed in claim 1, wherein the border of the pie-shaped configuration is defined by an angle of from about 19 degrees to about 30 degrees as measured from the center of the pit area.

5. The plurality of geometrical tennis lanes as claimed in claim 1, wherein the pit area is defined by a radius of from about 10 feet to about 40 feet.

6. The plurality of geometrical tennis lanes as claimed in claim 1, including a removable tennis net which is separate and removed from the central target area.

7. The plurality of geometrical tennis lanes as claimed in claim 1, including a ball-throwing means.

8. A plurality of geometrical tennis lanes forming a circle or a semi-circle and having generally triangular configurations, each of which comprises:

(a) a base line and central target area, wherein the base line and central target area are separated by a distance of from about 36 feet to about 43 feet;

(b) two separate elongated rectangular side targets, mutually spaced apart from each other, said side targets being defined by a height of from about 4 feet to about 18 feet, a width of from about 3 inches to about 6 inches and a length of from about 3 inches to about 6 inches, and co-planar with the side borders of each tennis lane, wherein the location of the two separate side targets of each tennis lane is defined by an angle of from about 19 degrees to about 23 degrees as measured from the center of the base line and intersecting with the border of the tennis lanes;

(c) a pit area having a radius of from about 20 feet to about 35 feet; and (d) a floor area having three distinct slopes wherein the first slope has a downward incline of from about 1% to about 4%, the second slope has a downward incline of from about 2% to 8%, and the third slope has a downward incline of from 1% to about 3%.

9. The plurality of geometrical tennis lanes as claimed in claim 8, including a barrier which covers the top of said tennis lanes.

10. The plurality of geometrical tennis lanes as claimed in claim 8, wherein the central target zone has an opening at the bottom.

11. The plurality of geometrical tennis lanes as claimed in claim 8, including a removably attachable net connected to two supports, mutually spaced apart and located at a distance of from about 8 feet to about 14 feet from the base line.

12. The plurality of geometrical tennis lanes as claimed in claim 8, wherein the length of said tennis lanes is from about 63 feet to about 100 feet.

13. The plurality of geometrical tennis lanes as claimed in claim 8, including a ball-throwing means.

14. The plurality of geometrical tennis lanes as claimed in claim 8, wherein the second slope is elevated above the third slope from about 1 foot to about 4 feet.

15. A plurality of geometrical tennis lanes forming a circle or a semi-circle, having generally triangular configurations, connectably attached to each other, and defined by overall lengths of from about 68 feet to about 91 feet, each of said tennis lanes comprising;

(a) a base line and central target area, said central target area having three different distinct target zones, and wherein the base line and central target area are separated by a distance of from about 38 feet to about 40 feet;

(b) two separate elongated rectangular side targets, mutually spaced apart from each other, said side targets defined by a height of from about 14 feet to about 18 feet, a width of from about 4 inches to about 6 inches, a length of from about 4 inches to about 6 inches and being co-planar with the side borders of each tennis lane, wherein the location of the two separate elongated rectangular side targets of each tennis lane is defined by an angle of from about 19 degrees to about 21 degrees as measured from the center of the base line and intersecting with the side borders of the tennis lanes;

(c) a pit area adjacent to the central target area, wherein said pit area has a radius of from about 25 feet to about 30 feet;

(d) a floor area having three distinct slopes wherein the first slope has a downward incline of from about 1% to about 3%, the second slope has an incline of from about 1% to about 7%, and the third slope has a downward incline of from about 1% to about 2%.

16. The plurality of geometrical tennis lanes claimed in claim 15, including a barrier which covers the top of said tennis lanes.

17. The plurality of geometrical tennis lanes claimed in claim 15, wherein the bottom of the central target zone has an opening of from about 3 inches to about 8 inches extending along the length of said central target zone.

18. The plurality of geometrical tennis lanes claimed in claim 15, including a ball-throwing means.

19. The plurality of geometrical tennis lanes claimed in claim 15, wherein the border of each pie-shaped configuration is defined by an angle of from about 19 degrees to about 23 degrees as measured from the center of the pit area.

20. The plurality of geometrical tennis lanes claimed in claim 15, including a net removably attached to two support posts, wherein said support posts are co-planar with the lane side borders and located from about 9 feet to about 12 feet from the base line.

* * * * *